United States Patent [19]

Smith et al.

[11] Patent Number: 4,699,161

[45] Date of Patent: Oct. 13, 1987

[54] NAIL POLISH REMOVER WAND

[76] Inventors: Louise Smith, 805 E. Butler Dr., Phoenix, Ariz. 85020; Frank W. Kautman, 1633 W. JoanDeArc, Phoenix, Ariz. 85029

[21] Appl. No.: 861,992

[22] Filed: May 12, 1986

[51] Int. Cl.[4] ..... A45D 29/17

[52] U.S. Cl. ..... 132/73.5; 15/244 R; 221/279; 401/57; 401/68

[58] Field of Search ..... 221/197, 198, 226, 279, 221/287; 401/175, 68, 90, 57; 15/244 R; 132/73, 73.5, 74.5

[56] References Cited

U.S. PATENT DOCUMENTS

| | | | |
|---|---|---|---|
| 953,374 | 3/1910 | Clark | 401/175 |
| 1,236,878 | 8/1917 | Salvas | 401/175 |
| 1,451,941 | 4/1923 | Clum | 401/175 |
| 1,844,285 | 2/1932 | Johnson | 221/279 X |
| 2,219,754 | 10/1940 | Skold | 91/67.4 |
| 2,294,001 | 8/1942 | Ritter | 221/279 X |
| 2,398,161 | 4/1946 | Skold | 15/214 |
| 2,598,325 | 5/1952 | Weekes | 221/226 X |
| 2,698,682 | 1/1955 | Bodan | 221/287 X |
| 2,760,302 | 8/1956 | Cheskin | 15/244 R X |
| 2,813,289 | 11/1957 | Even | 15/134 |
| 2,841,809 | 7/1958 | Oliver | 15/138 |
| 4,521,127 | 6/1985 | Tomburo et al. | 401/175 X |

FOREIGN PATENT DOCUMENTS

| | | | |
|---|---|---|---|
| 1062306 | 3/1967 | United Kingdom | 401/175 |

*Primary Examiner*—Steven A. Bratlie

*Attorney, Agent, or Firm*—Warren F. B. Lindsley

[57] ABSTRACT

An improved nail polish remover wand incorporating a replaceable cartridge of absorbent pads is disclosed wherein the individual pads are moved into position for use at the end of the wand and are subsequently ejected after use by rotating a threaded rod attached to a control knob.

4 Claims, 4 Drawing Figures

NAIL POLISH REMOVER WAND

BACKGROUND OF THE INVENTION

One of the more awkward and inconvenient procedures involved in the care of the nails is the removal of the old polish. This is ordinarily accomplished with the use of cotton balls or sponge saturated in a special solvent commonly known as polish remover.

This method is especially undesirable for use by a manicurist. In the interest of promoting her own business and showing off to advantage her own skills and the aesthetic benefits of professional nail care, the typical manicurist likes to keep her own nails well polished and in superior condition. This is especially difficult if one must contend with the old method of removing polish from the client's nails. Because the saturated cotton balls inevitably come into contact with the nails of the manicurist, her own nail polish is very quickly smudged, marred or removed.

The need therefore exists for a proper device or utensil that will permit a more convenient and tidy procedure for the removal of polish from the nails.

DESCRIPTION OF THE PRIOR ART

U.S. Pat. No. 2,813,289 discloses a nail cleaning device incorporating means for removing old polish and also a neans for applying a new coat of polish. The portion of the device that is intended for use in removing old polish comprises an elongated cylindrical tube containing a stack of compressed absorbent pads that are saturated with a sovent material. A piston at one end of the tube drives the pads toward the opposite open end when a shell surrounding the tube is rotated. The mechanism that drives the piston forward utilizes a helical groove engaged by a pin that extends laterally from the piston. The solvent is supplied from a chamber behind the piston through an opening in the center of the piston. In use, the pads are advanced until a fresh pad protrudes slightly from the open end. The tube with the protruding saturated pad is then employed to remove polish from one or more nails. After such use, the stack of pads is advanced again until the soiled pad is ejected and another fresh pad is moved into position for use.

In a variation of this device, the pads are housed in a dry condition and the solvent is applied at the time of use, either directly to the nail or to the protruding pad. A chamber and dispensing means for the solvent is incorporated in the device.

U.S. Pat. No. 2,841,809 discloses a fingernail polish removing tool again comprising an elongated cylindrical tube that houses a stack of compressed absorbent pads. The pads are moved by means of a follower plate toward an open end of the tube. A thumb piece engages the follower plate through a longitudinal slot in the side of the tube. A solvent fluid is held in a chamber at the end of the tube opposite the open end. The fluid from the chamber is admitted into an axial aperture through a needle valve. The aperture extends through the centers of the stacked pads to the center of the foremost pad at the tube opening. The foremost pad is supplied with the desired amount of fluid through appropriate manual control of the needle valve. The protruding moistened pad is employed to clean one or more nails and is then ejected by forward thumb pressure applied to the thumb piece.

U.S. Pat. No. 2,219,754 discloses a lipstick spreader comprising an elongated tubular container which is adapted to hold a series of lipstick spreading wads of porous latex rubber or like material. One end of the spreader is open and equipped with a narrow cross piece. The other end of the spreader has a removable cap with a spring pressed plunger for urging the wads in the direction of the cross piece and causing the wad at the open end to project around and beyond the cross piece and become operative for lipstick spreading purposes. The spring also causes the series of wads to advance toward the cross piece upon removal of the end wad after use of the latter.

U.S. Pat. No. 2,398,161 discloses another lipstick spreader comprising a tubular body with a slotted cross-wall at one end thereof, a lipstick spreading wad of porous rubber latex or like compressible material fitting against the outer face of the cross-wall, and an elongated plate-type wad retaining element which extends through, and is longitudinally slidable in the slot in the cross-wall. The spreader has a wad-encircling loop at its outer end, and is adapted in response to inward sliding movement to hold the wad in its operative position by causing a portion thereof to be compressed and clamped between the loop and the cross-wall and in response to outward sliding movement to release the wad for cleaning or replacement purposes.

This patent also discloses a similar lipstick spreader which also comprises an auxiliary tubular body which is aligned with and is rotatable relative to the main tubular body and has its outer end open and its inner end provided with a fixed cross-wall in abutment with the inner or open end of the main tubular body. In addition, the spreader comprises a spring in the main tubular body for urging the wad retaining element inward. An elongated screw-type member extends through an aperture in the central portion of the fixed cross-wall at the inner end of the auxiliary tubular body. It is so arranged that in response to relative rotation of the two bodies, it moves axially and in response to relative rotation of the two bodies in one direction, slides the wad retaining element outwardly against the force of the spring to effect release of the lipstick spreading wad. A further variation incorporates a cup-shaped retainer for a piece of lipstick which is advanced by relative rotation of two bodies.

A major inconvenience involved in the use of the foregoing prior art devices is the necessity of loading the absorbent cleaning pads individually. The elimination of this time consuming procedure is essential to the realization of a more practical and marketable device of this type.

SUMMARY OF THE INVENTION

In accordance with the invention claimed, an improved nail polish remover wand is provided comprising an elongated tubular device incorporating a cartridge containing a stack of compressed absorbent pads, each having a hand gripping collar or holder, that are drivcn toward an open end of the tubular device by a screw-type mechanism. The forward pad in the stack is moved to the end of the open tube where its protruding end is employed to remove old polish from the nail. After such use, the pad is advanced further until it is ejected. A new clean pad is then advanced into position for a subsequent cleaning operation.

It is, therefore, an object of the present invention to provide an improved device for use in removing old nail Polish from the nails.

Another object of the invention is to provide such a device in a form that is comfortable to hold in the hand and is readily controllable in use for its intended purpose.

A further object of the invention is to provide in such a device a means for holding absorbent pads saturated with sovent so that the pads may be conveniently manipulated to remove polish from the nails of another person or from one's own nails while avoiding contact of the pads with the fingers of the hand that is holding the device.

A still further object of the invention is to provide such a device in which provision is made for reloading the device with fresh pads in a very short time in contrast to the time consuming procedure of the prior art in which the pads were loaded individually.

A still further object of the invention is to provide in such a device a cartridge for holding a stack of absorbent pads whereby the pads are advanced for use from their initial positions within the cartridge and are ejected after use, the entire cartridge being replaced after its supply of pads is exhausted.

A still further object of the invention is to provide in such a device a screw-type mechanism which permits the convenient advancement and precise positioning of the absorbent pads at the tip of the device where their protruding ends may be employed in the nail polish removal operation.

Yet another object of the invention is to provide such a device that is simple in form and construction, its individual parts being inexpensively molded from thermoplastic materials.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
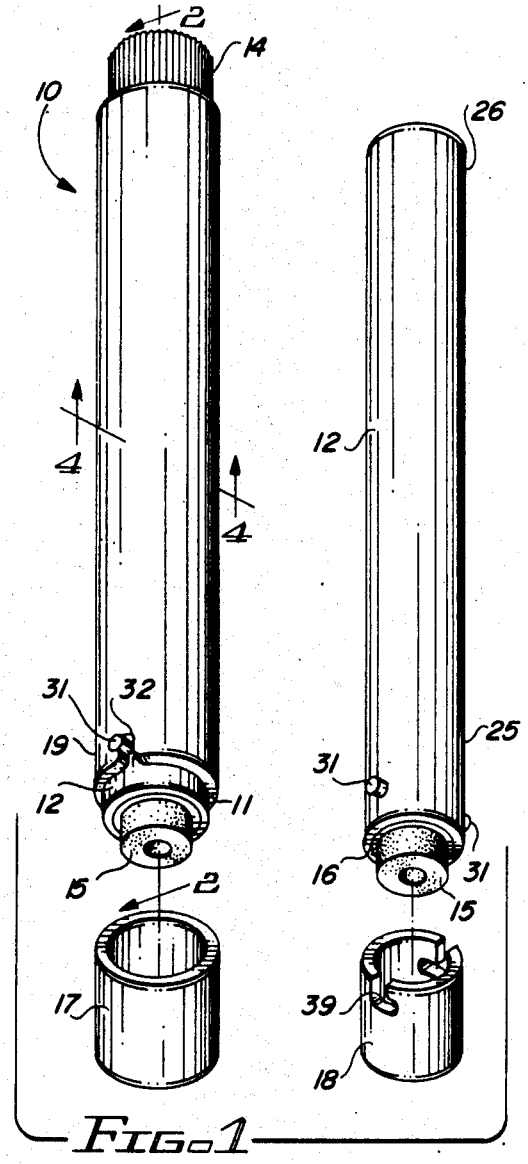
FIG. 1 is a perspective view showing the improved nail polish remover wand of the invention together with a spare cartridge of compressed cleaning pads.

Referring more particularly to the drawing by characters of reference, FIGS. 1-4 disclose a nail polish remover wand 10 embodying the invention and comprising a tubular cylindrical outer shell or housing 11, a cleaning-pad cartridge 12, a threaded drive rod 13, a control knob 14, cleaning pads 15 with individual cup-shaped collars or holders 16, a cap 17 for covering the tip of wand 10, and a cartridge cap 18.

Housing 11 is an elongated cylindrical tube, approximately three-fourths of an inch in diameter. It is open at its top or forward end 19 and closed at its other end 21 except for an axial clearance hole 22. At end 21, a neck 23 is formed, the outer diameter of which is approximately one-half inch in size. An annular disc-shaped depression 24 is formed directly under neck 23 inside housing 11 and coaxial with clearance hole 22.

Figure 4:
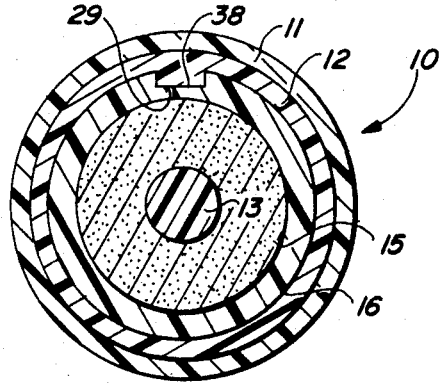
FIG. 4 is a cross-sectional view of the nail polish remover wand of FIG. 1 taken along the line 4—4.

Cartridge 12 is an elongated tube or shell with an outer diameter slightly smaller than the inside diameter of housing 11 so that it may fit and move smoothly within housing 11 when installed therein. The forward end 25 of cartridge 12 is open and the rearward end 26 is closed except for a central clearance hole 27 of the same diameter as hole 22 of housing 11. When cartridge 12 is installed in housing 11, as shown most clearly in FIG. 2, holes 22 and 27 are axially aligned and the flat end wall 28 of cartridge 12 forms with depression 24 a short cylindrical or disc-shaped cavity that is closed at both ends except for the axial chearance holes 22 and 27. A longitudinal ridge 29, as shown in FIG. 4, extends the length of cartridge 12 along its inside surface. Two small pegs 31 extend laterally from opposite outside surfaces of cartridge 12 at a location near forward end 25. When cartridge 12 is installed inside housing 11, the pegs 31 are captured within mating twist-lock slots 32 that are provided at corresponding locations in opposite walls of housing 11 at a location near forward end 19.

Drive rod 13 is approximately one-quarter inch in diameter and its length is approximately equal to that of housing 11. Rod 13 is threaded over most of its length with a smooth cylindrical shaft 33 at one end. The diameter of shaft 33 is just smaller in size than that of clearance holes 22 and 27 of housing 11 and cartridge 12, respectively. An integral disc-shaped retaining collar 34 extends radially from shaft 33 at a point about one-quarter inch from the termination of the threaded portion of rod 13. Collar 34 is shaped and dimensioned to fit snugly but freely rotationally within the cavity by depression 24 and the end wall of cartridge 12.

Knob 14 has the shape of a cup with a center post 35 that rises inside the cup from its center. The height of post 35 is somewhat shorter than the sides of the cup. An axial hole is provided in the center of post 35 to accommodate shaft 33 of rod 13.

Cleaning pads 15 comprise short cylinders of an absorbent material such as sponge, compressed cotton or a suitable synthetic material. Each pad 15 is held at one end inside a cup-shaped collar or holder 16 with approximately half the length of pad 15 protruding from the holder. A cylindrical opening 36 extends axially through the centers of pad 15 and holder 16. The diameter of hole 36 is just sufficient to provide clearance for rod 13. The uppermost holder 16′ differs slightly from all other holders 16 in that its flat base is reinforced by an outwardly protruding neck 37 and hole 36′ passing through holder 16′ is threaded to mate with the threaded portion of rod 13. Running longitudinally along the outside surface of holders 16 and 16′ at one side therof is a groove 38 that is shaped and dimensioned to mate slidably with ridge 29 of cartridge 12.

Cartridge 12 is intended to be made available commercially in a fully loaded state, i.e. with a stack of cup-held pads 16 already installed therein so that when the last pad 15 has been used and ejected from wand 10, the exhausted cartridge 12 is removed and replaced by a new cartridge. As indicated in the drawing, pads 16 and holders 16 in which they are individually contained are stacked end-to-end in cartridge 12, with the open ends of holders 16 and the protruding ends of pads 15 directed toward the open end of cartridge 12 with holder 16' and pad 15' being installed first.

Figure 2:
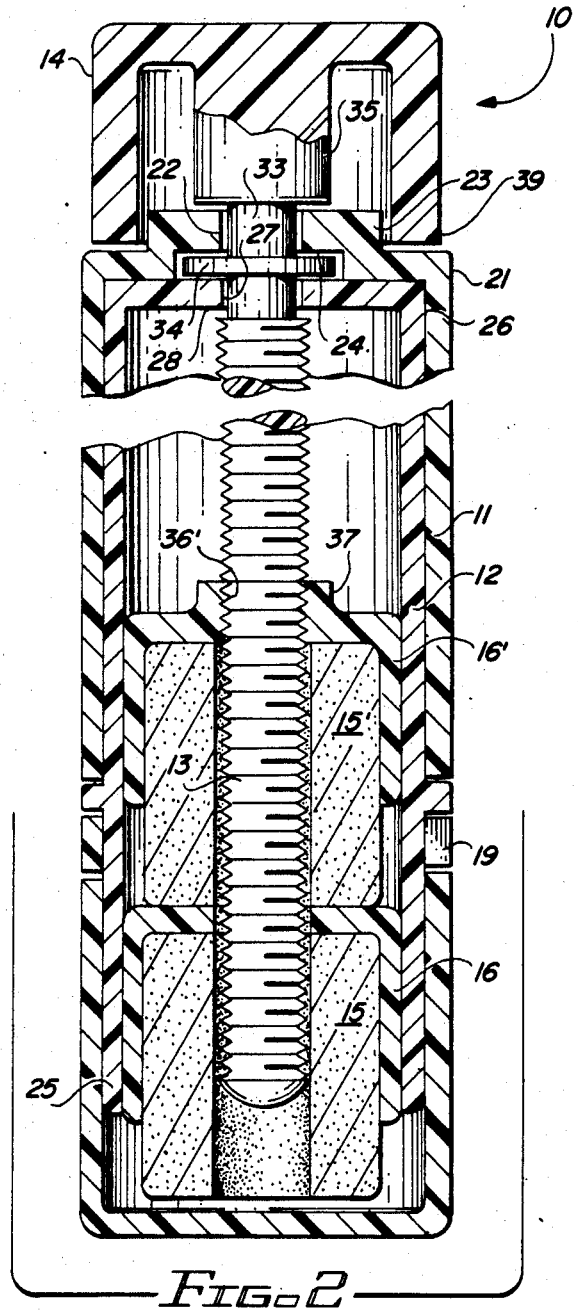
FIG. 2 is an enlarged cross-sectional view of the nail polish remover wand of FIG. 1 taken along line 2—2 thereof.
Figure 3:
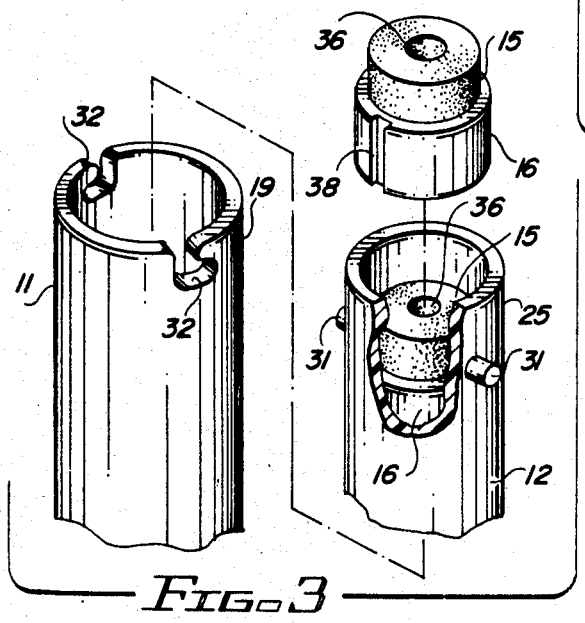
FIG. 3 is an exploded perspective view showing the tip of the wand housing, the forward end of the cartridge and an ejected cleaning pad.

Assembly of wand 10 proceeds as follows: Rod 13 is first inserted, shaft end first into the open forward end 19 of housing 11 with shaft 33 of rod 13 passing through clearance hole 22, and collar 34 moving into position inside depression 24. Knob 14 is then installed over the end of shaft 33, the axial hole in post 35 fitting with an interference fit over shaft 33 in a more or less permanently retaining condition wherein installed knob 14 retains rod 13 in a position that is stabilized by the mating of collar 34 with depression 24. As indicated in FIG. 2, rim 39 of knob 14 impinges loosely upon the end of housing 11 at its outer edges and the end of post 35 impinges in like manner upon the end surface of neck 23 to further stablize the position of rod 13. Cartridge 12 is installed next by first inserting its end 26 into the open forward end 19 of housing 11. Knob 14 is then rotated to engage threaded opening 36' of holder 16'. Rotation of knob 14 and rod 13 continues until cartridge 13 with its charge of pads 15 is fully drawn inside housing 11. At this time, pegs 31 of cartridge 13 will have entered slots 32 of housing 11. Pegs 31 are then rotated and locked into position to complete the cartridge installation.

Wand 10 is now ready for use. In such use, the protruding pad 15 at the tip 19 of wand 10 is first dipped into a shallow container of nail polish remover fluid. Wand 10 is then gripped as one would hold a pencil or similar instrument and the saturated pad 15 is brushed over the surface of the nail to remove the old coat of polish. When pad 15 has become loaded with dissolved polish to the extent that it is no longer usable, knob 14 is rotated in a direction that advances the stack of pads held by cartridge 12 toward the open ends of cartridge 12 and housing 11. As the soiled cartridge 15 and its associated holder 16 leave cartridge 12, they may be directed by the operator toward a waste container for disposal, with no contact occurring between the soiled and solvent saturated pad 15 and the well manicured fingers of the operator. After disposal of the soiled pad, knob 14 is rotated further to advance the next pad into position for use.

It will be noted that during the rotation of knob 14 and rod 13, rotation of holder 16' within cartridge 12 is prevented by the mating of groove 38 of holder 16' with ridge 29 of cartridge 12. Being thus prevented from rotation, holder 16' is constrained to move forward by virtue of its threaded engagement with rotating rod 13. Ideally, holes 36 through the stacked and compresses pads 15 contained in cartridge 12 are reduced in diameter by such compression with the result that the inwardly bulging centers of pads 15 are also engaged by the threads of rod 13 and are thereby substantially secured in position.

When wand 10 is not in use, cap 17 fits snugly over the end of cartridge 12 which protrudes from end 19 of housing 11, cap 17 protecting the end of pad 15 that is in position for next use. While wand 10 is in use, cap 17 may be pressed over the top of knob 14, the interior of cap 17 being formed to fit over the outside surface of knob 14.

Cartridge cap 18 serves a similar purpose when installed over the open end of cartridge 12. Twist-lock slots 39 are incorporated in cap 18 for engagement with pegs 31 of cartridge 12.

While pads 15 are normally installed in cartridge 12 in a dry condition, a variation of the invention in which the pads are already saturated with a liquid such as nail polish remover is not precluded. In that case, caps 17 and 18 are particularly useful as means for preventing evaporation of the fluid.

All of the individual parts of wand 10, with the exception of pads 15, are inexpensively molded from a thermoplastic material so that wand 10 and the replacement cartridge 12 may be produced at low cost.

An improved nail polish remover wand is thus provided in accordance with the stated objects of the invention, and although but a single embodiment of the invention has been illustrated and described, it will be apparent to those skilled in the art that various changes and modifications may be made without departing from the spirit of the invention or from the scope of the appended claias.

What is claimed is:

1. A fingernail polish removing wand comprising:

a hollow cylindrical housing open at opposite ends thereof, an elongated hollow cartridge for detachably mounting in said housing for discharging absorbent pads from a discharge end thereof, said cartridge having a ridge arranged axially thereof along its inner surface and containing a plurality of individual cylindrically shaped absorbent pads, each pad having a holding means covering at least a part of common end thereof axially arranged within said cartridge along its length in a common direction, each of said pads and its associated holding means having an opening extending axially therethrough for receiving a threaded drive rod, a threaded drive rod arranged to extend longitudinally through said opening in each of said pads when said cartridge is mounted in said housing, said holding means of the pad at the end of said cartridge opposite said discharge end being slidably connected to said ridge and threadedly connected to one end of said drive rod, cap means arranged at the end of said housing opposite said discharge end for connection to said one end of said drive rod for rotation thereof, thereby threadedly moving said one of said pads and the other of said pads axially aligned therewith in said cartridge sequentially to and through said discharge end.

2. The fingernail polish removing wand set forth in claim 1 wherein:

said holding means comprises a cup-shaped configuration for fitting over one end of said absorbent pad.

3. The fingernail polish removing wand set forth in claim 2 wherein:

said cup-shaped configuration is formed of a plastic material.

4. The fingernail polish removing wand set forth in claim 3 wherein:

said cup-shaped configuration of said holding means at the end of said housing is provided with a flange around said opening extending axially therethrough, and said flange is threadedly connected to said drive rod.

* * * * *